US010648334B2

(12) United States Patent
Wang et al.

(10) Patent No.: US 10,648,334 B2
(45) Date of Patent: May 12, 2020

(54) LASER-ASSISTED TUNNEL BORING MACHINE AND ROCK FRAGMENTING METHOD THEREFOR

(71) Applicant: Dalian University of Technology, Dalian, Liaoning Province (CN)

(72) Inventors: Zhengzheng Wang, Dalian (CN); Yang Gao, Dalian (CN)

(73) Assignee: DALIAN UNIVERSITY OF TECHNOLOGY, Dalian, Liaoning (CN)

( * ) Notice: Subject to any disclaimer, the term of this patent is extended or adjusted under 35 U.S.C. 154(b) by 0 days.

(21) Appl. No.: 16/076,822

(22) PCT Filed: Jan. 18, 2017

(86) PCT No.: PCT/CN2017/071564

§ 371 (c)(1),
(2) Date: Aug. 9, 2018

(87) PCT Pub. No.: WO2018/132979

PCT Pub. Date: Jul. 26, 2018

(65) Prior Publication Data

US 2019/0017380 A1 Jan. 17, 2019

(51) Int. Cl.
*E21D 9/087* (2006.01)
*E21D 9/10* (2006.01)
(Continued)

(52) U.S. Cl.
CPC ..... *E21D 9/087* (2013.01); *E21C 37/16* (2013.01); *E21D 9/003* (2013.01); *E21D 9/0879* (2016.01);
(Continued)

(58) Field of Classification Search
CPC ..... E21D 9/0642; E21D 9/087; E21D 9/1073; E21D 9/06; E21D 9/08; E21D 9/10;
(Continued)

(56) References Cited

U.S. PATENT DOCUMENTS 3,475,055 A * 10/1969 Snedden ..... E21B 7/14 299/14
3,876,251 A * 4/1975 Boyd ..... E21C 27/46 299/1.1
(Continued)

FOREIGN PATENT DOCUMENTS

CN 102364049 A 2/2012
CN 202391431 U 8/2012
(Continued)

*Primary Examiner* — Janine M Kreck
*Assistant Examiner* — Michael A Goodwin
(74) *Attorney, Agent, or Firm* — Muncy, Geissler, Olds & Lowe, PC

(57) ABSTRACT

A laser-assisted tunnel boring machine and a rock fragmenting method thereof belong to the technical field of tunnel engineering. Two rock fragmenting modes exist: a laser-cutter rock fragmenting mode and a cutter rock fragmenting mode, wherein the two rock fragmenting modes are switched by an intelligent control system; and for the laser-assisted rock fragmenting mode, hot fragmenting is mainly performed using lasers which assisted by water spray systems, to achieve the purposes of auxiliary rock fragmenting by laser radiation for hot cracking and water spray for quick cooling, and mechanical rock fragmenting for excavation.

3 Claims, 2 Drawing Sheets

(51) Int. Cl.

| | |
|---|---|
| ***E21C 37/16*** | (2006.01) |
| ***E21D 9/00*** | (2006.01) |
| ***E21D 9/08*** | (2006.01) |
| *E21B 7/15* | (2006.01) |

(52) U.S. Cl.
CPC ..... *E21D 9/1066* (2013.01); *E21D 9/1073* (2013.01); *E21B 7/15* (2013.01)

(58) Field of Classification Search
CPC ... E21C 37/16; E21B 7/14; E21B 7/15; B23K 26/356; B23K 26/14; B23K 26/26; B23K 26/146; B23K 26/1462
See application file for complete search history.

(56) References Cited

U.S. PATENT DOCUMENTS

| | | | | |
|---|---|---|---|---|
| 5,765,925 | A | 6/1998 | Kondo et al. | |
| 2014/0231398 | A1* | 8/2014 | Land | B23K 26/0093 219/121.72 |
| 2014/0327292 | A1* | 11/2014 | Kim | E21D 9/1066 299/29 |
| 2017/0152744 | A1* | 6/2017 | Mladjan | E21C 37/18 |
| 2017/0306703 | A1* | 10/2017 | Samuel | E21B 44/00 |

FOREIGN PATENT DOCUMENTS

| | | | | | |
|---|---|---|---|---|---|
| CN | 202788865 | U | | 3/2013 | |
| CN | 103234903 | A | | 8/2013 | |
| GB | 1422637 | A | * | 1/1976 | E21D 9/1073 |
| GB | 1446464 | A | * | 8/1976 | E04C 3/34 |

* cited by examiner

LASER-ASSISTED TUNNEL BORING MACHINE AND ROCK FRAGMENTING METHOD THEREFOR

TECHNICAL FIELD

The present invention relates to a laser-assisted tunnel boring machine and a rock fragmenting method therefore, which belongs to the technical field of tunnel engineering.

BACKGROUND

At present, the tunnel boring machine method and the blasting method are two main methods used for tunnel excavation. In the conventional tunneling excavation method, rock is sheared, squeezed and fragmented using a large-sized cutter, and then the fragmented rock is transported by mated transportation equipment. Because the traditional tunnel boring machine method has the disadvantages of poor adaptability to geological conditions of non-uniformly distributed soft and hard rock and different rock faces, limited use and cutter wear, the tunneling efficiency is reduced, and construction costs are increased.

SUMMARY

The present invention aims to solve the technical problems about how to select a highly-efficient rock fragmenting mode and how to effectively reduce cutter wear under changeable geological conditions, to improve the rock fragmenting efficiency.

The present invention has the technical solution:

A laser-assisted tunnel boring machine, characterized in that lasers, water spray systems, a real-time monitoring system and an intelligent control system are additionally added onto a traditional tunnel boring machine;

lasers: a plurality of lasers are installed on a cutter head of the tunnel boring machine, to form a laser-cutter rock fragmenting mode mainly based on hot fragmenting, melting and vaporization; to guarantee highly-efficient auxiliary rock fragmenting, the lasers are divided into various work types of lasers in accordance with laser parameters (wave type, wave length, intensity, pulse width, power density and the like), to perform systematic comparative analysis according to rock fragmenting information collected by the monitoring system, and different lasers are switched for rock of different types and different intensities, thereby increasing the adaptability of the tunnel boring machine to strata;

water spray systems: the water spray systems are arranged around the lasers, which use laser radiation to produce high temperature, spray water to reduce temperature, and use instantaneous high temperature difference to make rock produce tensile stress and then fragment, thereby achieving the purposes of auxiliary rock fragmenting by laser radiation for hot cracking and water spray for quick cooling, and mechanical rock fragmenting for excavation;

real-time monitoring system: the real-time monitoring system comprises an image visualization module, a sensor module and an information collection module, wherein to guarantee the safety of the laser-assisted tunnel boring machine and achieves switching of the fragmenting modes in time, the information collection module simultaneously collects data of different types in real time, to judge rock of different types and intensities in time in the tunneling process;

intelligent control system: the intelligent control system conditions and recognizes various physical quantity signals output by the information collection module, thereby intelligently changing the number and spatial layout of the lasers, laser types, rock fragmenting modes and rotational speed of the cutter head, and improving the adaptability of the tunnel boring machine to different geological conditions.

A rock fragmenting method for the laser-assisted tunnel-boring machine, characterized in that:

the laser-assisted tunnel-boring machine includes two rock fragmenting modes: a laser-cutter rock fragmenting mode and a cutter rock fragmenting mode, the intelligent control system recognizes data output by the information collection module, and a cutter head drive device achieves recognition and switching of the two rock fragmenting modes, to divide a complicated stratum into a hard rock stratum and a soft rock stratum, wherein the laser-cutter rock fragmenting mode is used in the hard rock stratum, so that the rock fragmenting efficiency can be improved and the cutter wear can be reduced, and the cutter rock fragmenting mode is used in the soft rock stratum, so that construction costs are reduced.

The present invention has the effects and advantages that: by means of a laser-assisted tunnel boring machine and a rock fragmenting method therefore, the adaptability of the tunnel boring machine to complicated geological conditions of alternatively distributed soft and hard rock is improved; and by intelligently selecting a rock fragmenting mode, not only the rock fragmenting efficiency is improved, but also construction costs are saved.

Figure 1:
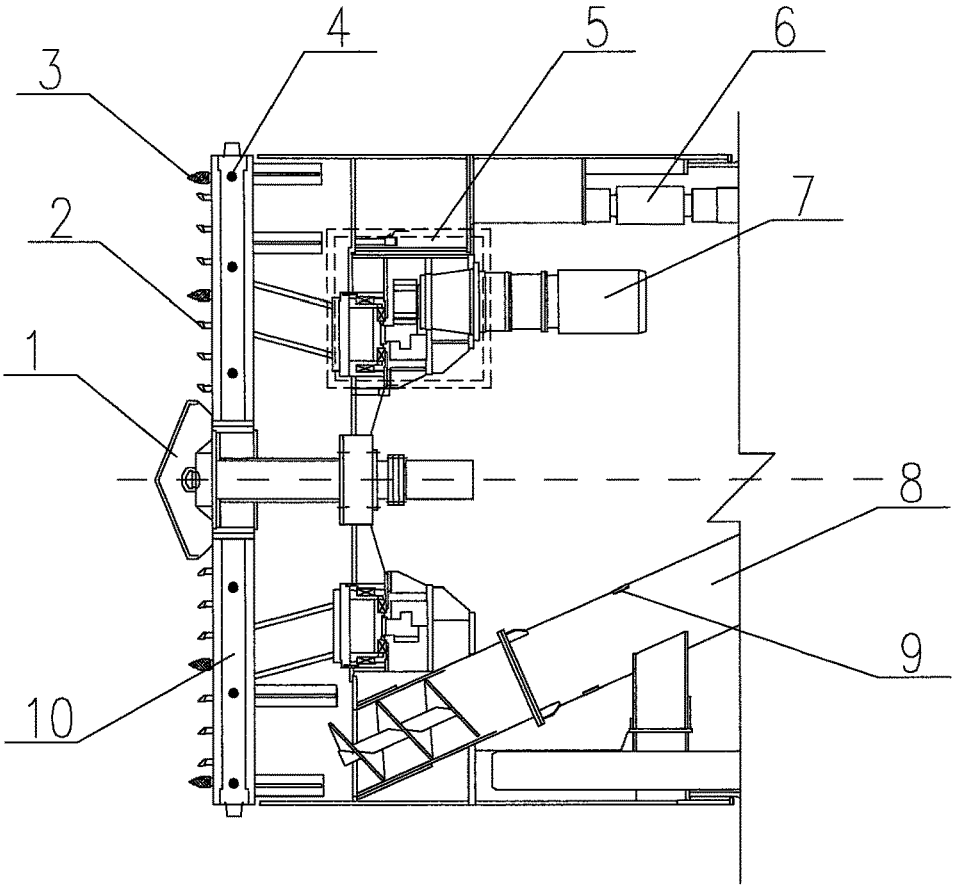
FIG. 1 is a longitudinal sectional view showing a tunnel-boring machine.

Legends: 1. drill bit; 2. cutter blade; 3. laser; 4. sensor subsystem; 5. switching center; 6. information collection module; 7. drive device; 8. spiral conveyor; 9. fiber grating sensor; 10. cutter head; 11. water spray system.

DETAILED DESCRIPTION

Specific embodiments of the present invention are described below in detail in combination with the technical solution and accompanying drawings.

For the traditional tunnel boring machine, the cutter head 10 is driven to rotate by the drive device 7, and a thrust cylinder of the tunnel boring machine is enabled, to push a shield tunneling machine forward, the cutter head is continuously rotated along with the pushing forward of the thrust cylinder, and the fragmented rock sheared, squeezed and crushed is sent to a belt conveyer by the spiral conveyor 8 and then is transported to the outside by the belt conveyer.

The lasers 3 and water spray systems 11 alternated with the cutter blades 2 are arranged on the cutter head 10 based on the traditional tunnel boring machine, wherein optical fiber lasers are used as the lasers. By setting different output powers to have various work types so as to adapt to rock of different intensities and by setting that the sensor subsystem 4 comprises a monitoring system composed of a pressure sensor, a temperature sensor and an ultrasonic sensor to detect different geological conditions in the tunneling process in time, the information collection module 6 integrates data collected by different types of sensors and then transmits the data to the intelligent control system in real time, and the intelligent control system recognizes information and then makes an adjustment through the drive device 7, thereby intelligently changing the number and spatial layout of the lasers, and work types of the lasers.

Figure 2:
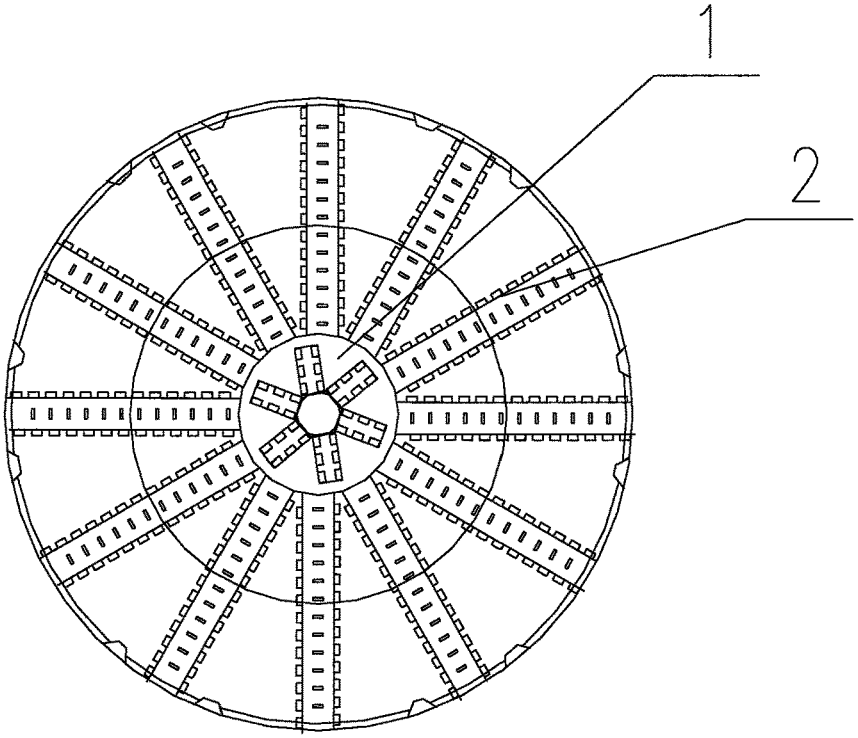
FIG. 2 is a sectional view showing a cutter head of a cutter rock fragmenting mode.
Figure 3:
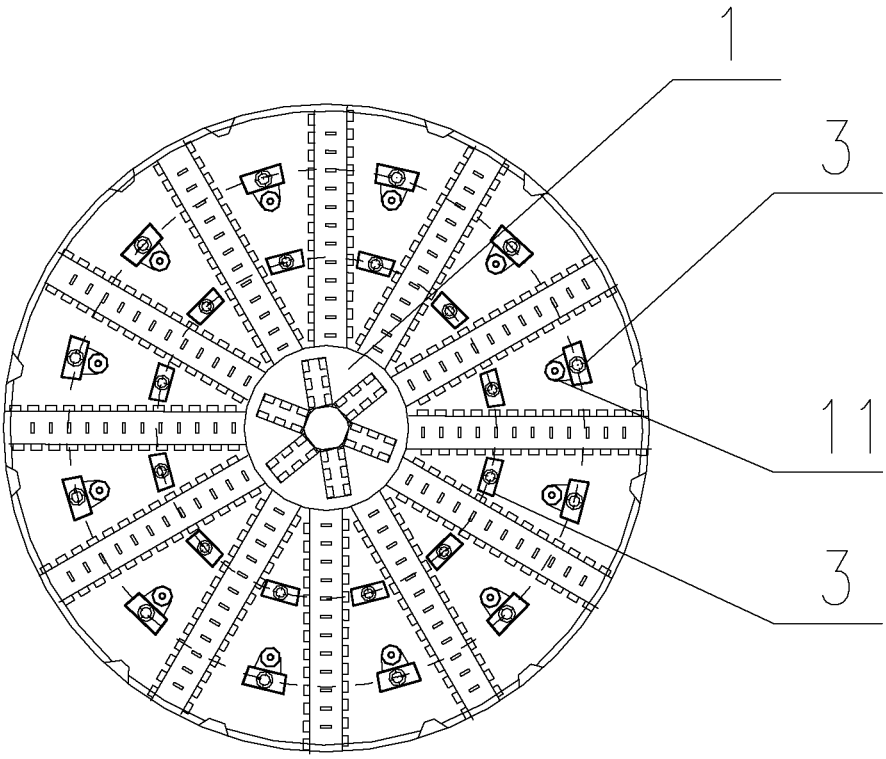
FIG. 3 is a sectional view showing a cutter head of a laser-cutter rock fragmenting mode.

For the two rock fragmenting modes, i.e. the cutter rock fragmenting mode shown in FIG. 2 and the laser-cutter rock fragmenting mode shown in FIG. 3, in the tunneling and excavation process of the tunnel boring machine, by detecting geology in advance by the drill bit 1, monitoring in real time by the sensor subsystem 4, and sensing the pressure of the spiral conveyor 8 by the fiber grating sensor 9, the intelligent control system controls the switching center 5 to select different rock fragmenting modes through the drive device.

We claim:

1. A laser-assisted tunnel boring machine, wherein lasers, water spray systems, a real-time monitoring system and an intelligent control system are added onto a tunnel boring machine;

the laser-assisted tunnel boring machine includes two rock fragmenting modes: a laser-cutter rock fragmenting mode and a cutter rock fragmenting mode;

lasers: a plurality of lasers are installed on a cutter head of the tunnel boring machine, to form a laser-cutter rock fragmenting mode based on hot fragmenting, melting and vaporization;

water spray systems: water spray systems are located around the lasers, which use laser radiation to produce high temperature, spray water to reduce temperature, and use instantaneous high temperature difference to make rock produce tensile stress and then fragment;

real-time monitoring system: the real-time monitoring system comprises an image visualization module, a sensor module and an information collection module, wherein to guarantee the safety of the laser-assisted tunnel boring machine and achieves switching of the fragmenting modes, the information collection module simultaneously collects data in real time, to judge different types and intensities of rock in time in the tunneling process;

intelligent control system: the intelligent control system conditions and recognizes signals output by the information collection module, and a cutter head drive device achieves recognition and switching of the two rock fragmenting modes, to divide a complicated stratum into a hard rock stratum and a soft rock stratum, wherein the laser-cutter rock fragmenting mode is used in the hard rock stratum, and the cutter rock fragmenting mode is used in the soft rock stratum, wherein the intelligent control system achieves switching of the laser-cutter rock fragmenting mode and the cutter rock fragmenting mode, and controls the number and spatial layout of the lasers, laser types and rotational speed of the cutter head, thereby improving the adaptability of the tunnel boring machine to different geological conditions.

2. The laser-assisted tunnel boring machine according to claim 1, wherein the lasers and water spray systems alternated with cutter blades are arranged on the cutter head.

3. The laser-assisted tunnel boring machine according to claim 1, wherein optical fiber lasers are used as the lasers.

* * * * *